US009636538B2

(12) United States Patent
DiPasquale

(10) Patent No.: US 9,636,538 B2
(45) Date of Patent: May 2, 2017

(54) FULL BODY MULTIDIRECTIONAL EXERCISE APPARATUS AND METHOD THEREFOR

(71) Applicant: Christopher DiPasquale, Phoenix, AZ (US)

(72) Inventor: Christopher DiPasquale, Phoenix, AZ (US)

( * ) Notice: Subject to any disclaimer, the term of this patent is extended or adjusted under 35 U.S.C. 154(b) by 0 days.

(21) Appl. No.: 14/731,317

(22) Filed: Jun. 4, 2015

(65) Prior Publication Data

US 2016/0008653 A1 Jan. 14, 2016

Related U.S. Application Data

(60) Provisional application No. 62/022,766, filed on Jul. 10, 2014.

(51) Int. Cl.

| | |
|---|---|
| ***A63B 21/06*** | (2006.01) |
| ***A63B 21/072*** | (2006.01) |
| ***A63B 21/075*** | (2006.01) |
| ***A63B 21/28*** | (2006.01) |

(52) U.S. Cl.

CPC ..... *A63B 21/28* (2013.01); *A63B 21/075* (2013.01); *A63B 21/0722* (2015.10); *A63B 21/0724* (2013.01); *A63B 21/0728* (2013.01)

(58) Field of Classification Search

CPC ..... A63B 21/1469; A63B 21/1496; A63B 21/072–21/0783; A63B 21/28; A63B 21/285

USPC ..... 482/92, 93, 105–109

See application file for complete search history.

(56) References Cited

U.S. PATENT DOCUMENTS

| | | | | | |
|---|---|---|---|---|---|
| 681,664 | A * | 8/1901 | Addleman | A63B 21/154 | 482/92 |
| 2,937,023 | A * | 5/1960 | Seymour | A63B 21/28 | 119/769 |
| 3,223,413 | A * | 12/1965 | Whitney | A63B 21/28 | 273/451 |
| 4,132,408 | A * | 1/1979 | Sabat | F41B 15/02 | 463/47.5 |
| 4,252,316 | A * | 2/1981 | Price | A63B 21/0728 | 482/106 |
| 4,284,274 | A * | 8/1981 | Boothe | A63B 21/28 | 482/92 |
| 4,627,617 | A * | 12/1986 | Gilmore | A63B 21/154 | 482/131 |

(Continued)

*Primary Examiner* — Stephen Crow
*Assistant Examiner* — Garrett Atkinson
(74) *Attorney, Agent, or Firm* — Weiss & Moy, P.C.; Veronica-Adele R. Cao

(57) ABSTRACT

A multidirectional exercise apparatus is disclosed. The multidirectional exercise apparatus has a center bar and two handles pivotably coupled at opposite ends of the center bar. Each handle may rotate through 360° about the end of the center bar. The apparatus may also have a locking mechanism coupled to each handle, wherein the locking mechanism may lock the handle into place and prevent the handle from rotating about the end of the center bar. The apparatus may also have a rotation bar removably coupled about the center bar that may rotate through 360° about the center bar. The apparatus may be operated by two users simultaneously and may also be adapted for operation by a single user.

17 Claims, 6 Drawing Sheets

(56) References Cited

U.S. PATENT DOCUMENTS 4,852,873 A * 8/1989 O'Donnell ..... A63B 21/00043 482/122
4,863,158 A * 9/1989 Tassone ..... A63B 21/0004 482/106
RE33,218 E * 5/1990 Twardosz ..... A63B 21/0724 482/106
5,009,414 A * 4/1991 Bass ..... A63B 69/345 128/869
5,284,459 A * 2/1994 Podd, III ..... A63B 21/0004 482/51
5,360,386 A * 11/1994 Brumfield ..... A63B 21/28 482/133
5,464,209 A * 11/1995 Sang ..... A63B 69/0075 473/419
5,464,379 A * 11/1995 Zarecky ..... A63B 21/0728 482/106
5,474,511 A * 12/1995 Dantolan ..... A63B 21/05 482/109
5,496,243 A * 3/1996 Allen ..... A63B 21/0601 482/106
5,529,557 A * 6/1996 Barton ..... A63B 21/0083 482/112
5,674,159 A * 10/1997 Davidson ..... A63B 21/1663 446/253
5,846,171 A * 12/1998 Hollowell ..... A63B 21/28 482/109
6,022,300 A * 2/2000 Hightower ..... A63B 21/0724 482/106
6,722,656 B2 * 4/2004 Heglund, Jr. ..... A63B 69/004 273/451
6,752,747 B2 * 6/2004 Yu ..... A63B 21/00043 482/110
7,163,496 B1 * 1/2007 Trotter ..... A63B 21/4017 482/100
7,201,711 B2 * 4/2007 Towley, III ..... A63B 21/0605 482/106
7,520,843 B1 * 4/2009 Goddard ..... A63B 21/0724 482/104
7,625,323 B1 * 12/2009 Lin ..... A63B 21/015 482/112
8,337,372 B1 * 12/2012 Boterenbrood ..... A01B 1/02 294/49
8,556,781 B1 * 10/2013 Fitzpatrick ..... A63B 21/0724 482/106
9,126,079 B2 * 9/2015 Jordan ..... A63B 21/072
2007/0243977 A1 * 10/2007 Zeien ..... A63B 21/4017 482/106
2008/0040891 A1 * 2/2008 Tyler ..... A63B 21/4035 16/421

* cited by examiner

FULL BODY MULTIDIRECTIONAL EXERCISE APPARATUS AND METHOD THEREFOR

CROSS-REFERENCE TO RELATED APPLICATION

This non-provisional application claims priority to U.S. Provisional Application No. 62/022,766 filed on Jul. 10, 2014 in the name of the Applicant herein.

FIELD OF THE INVENTION

The present invention relates generally to exercise equipment and, more specifically, to a multidirectional exercise apparatus which may be operated by one or more users.

BACKGROUND OF THE INVENTION

A barbell is a piece of exercise equipment that may be used in weight training, weightlifting, and powerlifting. A barbell is usually a long bar that has weight plates that are attached at each end and secured thereto by collars that prevent the weights from sliding off of the barbell during exercise. A barbell can vary in length; e.g. 4 feet to 8 feet. A barbell is usually operated by only one user at a time. A spotter may be used to support the user during a particular exercise by making sure the user is exercising with proper form, by encouraging the user to lift or push more weight than usual, and by occasionally intervening or assisting with a lift. For example, a user may lie in a supine position on a bench to perform a bench press, engaging his stabilizing muscles as well as his main target muscle groups (pectorals) to move the barbell in repetitive motions. The spotter may stand behind the user, with his knees near the user's head, and place his fingertips or palms under the middle area of the barbell help ensure that the user does not drop or lose control of the barbell due to fatigue or inexperience.

While it is beneficial to provide a barbell for weight training, the shape of the barbell and its lack of moving parts limit the types of exercises that one can perform with the conventional barbell. There may be instances wherein the user may wish to use a piece of exercise equipment for single-user exercises like bench presses, bicep curls, deadlifts, etc. But there may also be instances wherein a user may wish to incorporate the opposing force of another user during an exercise without having to use a different piece of exercise equipment. Therefore, it would be desirable to provide a multidirectional exercise apparatus that is capable of being operated by a single user and that is also capable of being operated by two users who may each move freely through various positions to oppose the other user's pushing, pulling, and rotation forces.

SUMMARY

In accordance with one embodiment of the present invention, a multidirectional exercise apparatus is disclosed. The apparatus comprises: a center bar having two opposite ends; and two handles, each handle pivotably coupled to one end of the center bar; wherein each handle is coupled perpendicularly to the center bar.

In accordance with another embodiment of the present invention, a multidirectional exercise apparatus is disclosed. The exercise apparatus comprises: a center bar having two opposite ends; two plate posts extending from the two opposite ends of the center bar; two handles, each handle pivotably coupled to one end of the center bar, wherein each handle comprises: a pivot tube coupled about one of the plate posts; a cross bar positioned perpendicularly in relation to the center bar; and two connecting arms, each connecting arm coupled at one end to the pivot tube and coupled at another end to the cross bar; and two end caps, each end cap coupled about one of the plate posts.

In accordance with another embodiment of the present invention method of exercise involving two users is disclosed. The method comprises the steps of: providing a multidirectional exercise apparatus comprising: a center bar having two plate posts extending from two opposite ends of the center bar; two handles, each handle pivotably coupled to one of the plate posts; and two locking mechanisms, one locking mechanism coupled to each handle, wherein the locking mechanism is adapted to lock the handle in place and prevent the handle from rotating about the plate post; wherein each handle is coupled perpendicularly to the center bar; gripping one handle by a first user; gripping another handle by a second user; supporting a weight of one end of the apparatus by the first user while resisting an opposing force applied by the second user.

BRIEF DESCRIPTION OF THE DRAWINGS

The present application is further detailed with respect to the following drawings. These figures are not intended to limit the scope of the present application, but rather, illustrate certain attributes thereof.

DETAILED DESCRIPTION OF THE INVENTION

The description set forth below in connection with the appended drawings is intended as a description of presently preferred embodiments of the disclosure and is not intended to represent the only forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

FIGS. 1-6 together disclose a multidirectional exercise apparatus 10. The exercise apparatus 10, in its simplest form, may have a center bar 12 with a handle 24 pivotably and removably coupled at one end or both ends of the center bar 12.

Figure 1:
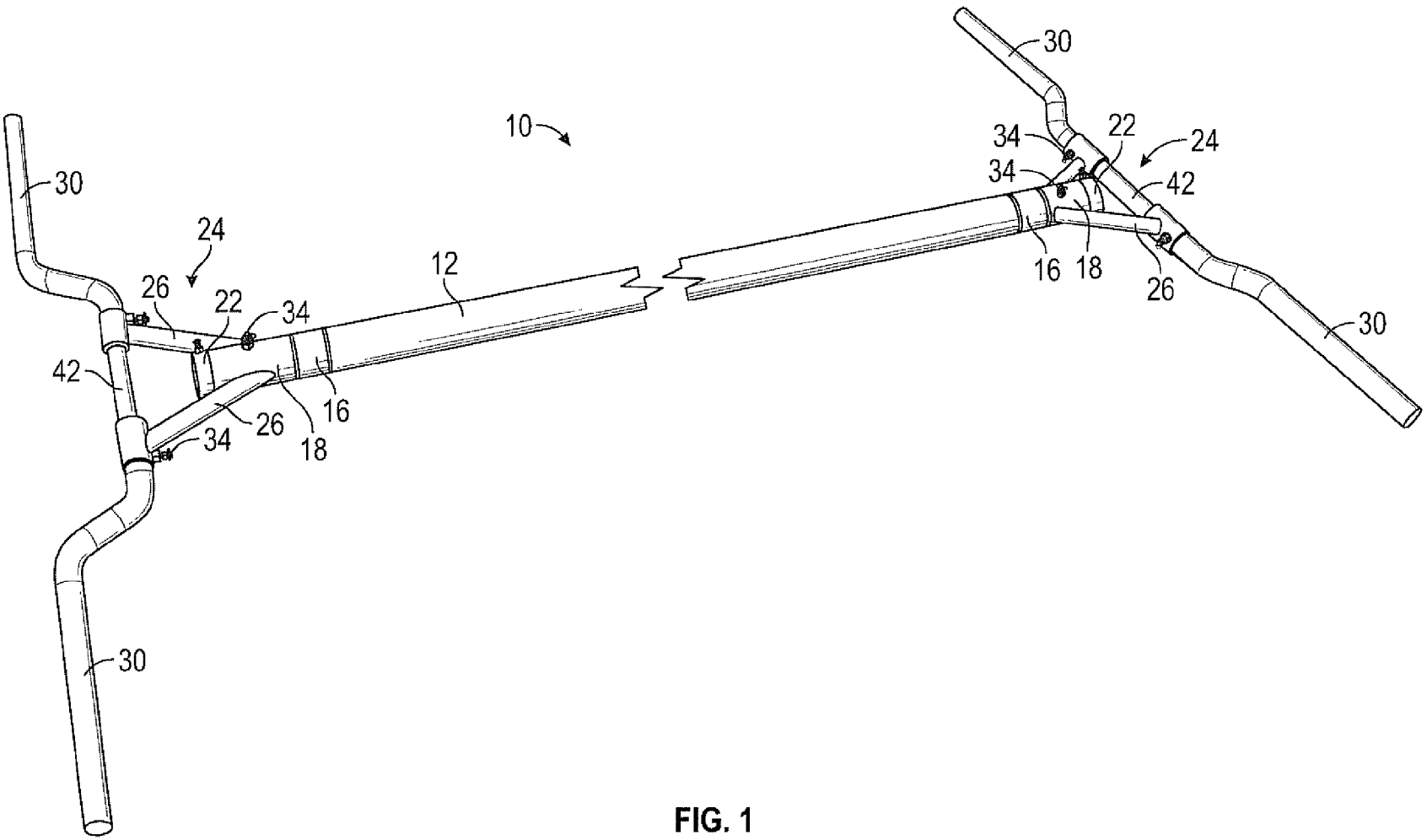
FIG. 1 is a perspective view of a multidirectional exercise apparatus in accordance with one or more aspects of the present invention.
Figure 2:
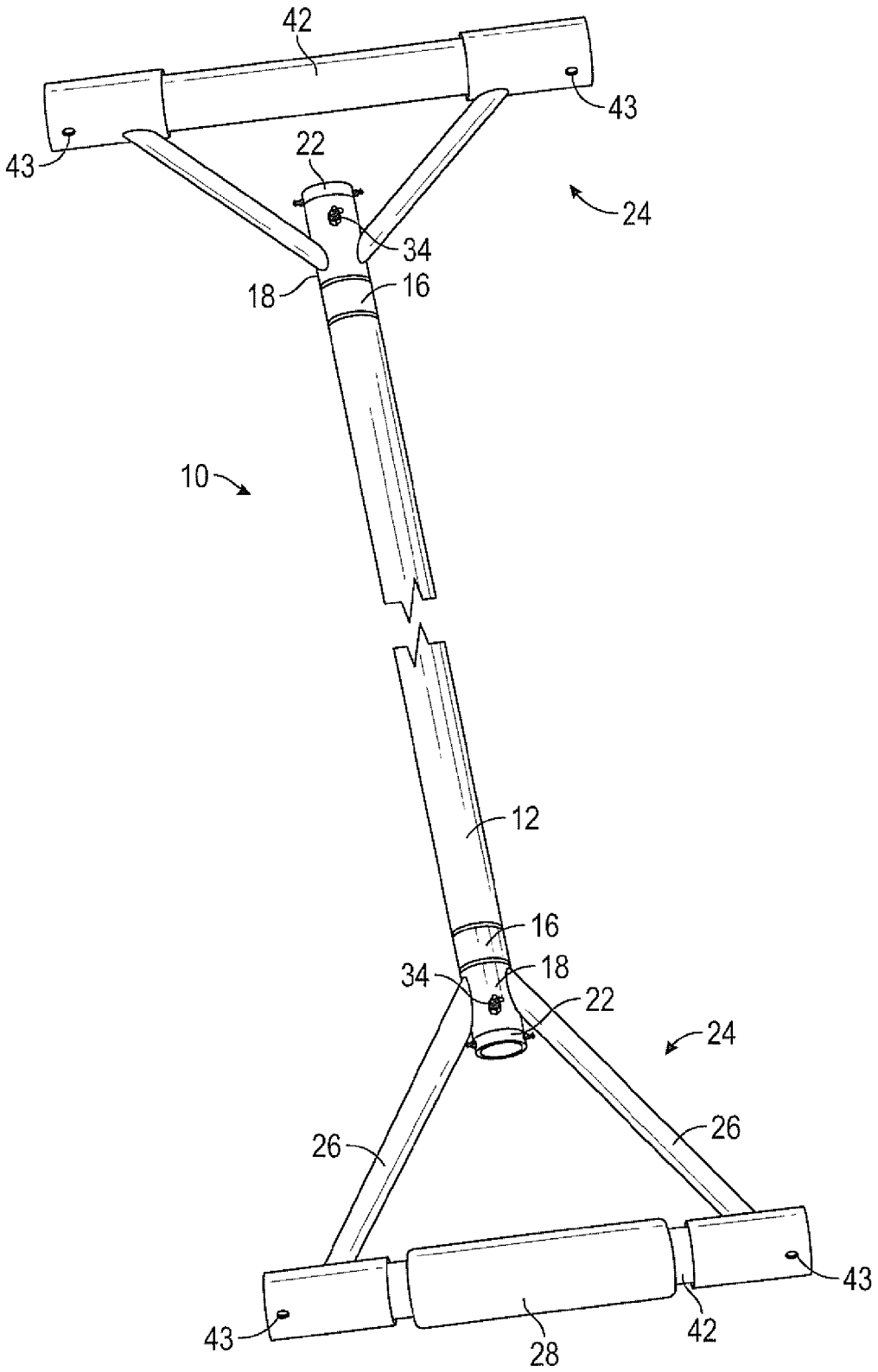
FIG. 2 is a perspective view of the multidirectional exercise apparatus of FIG. 1, shown with the hand grips removed from the cross bars of the handles.
Figure 3:
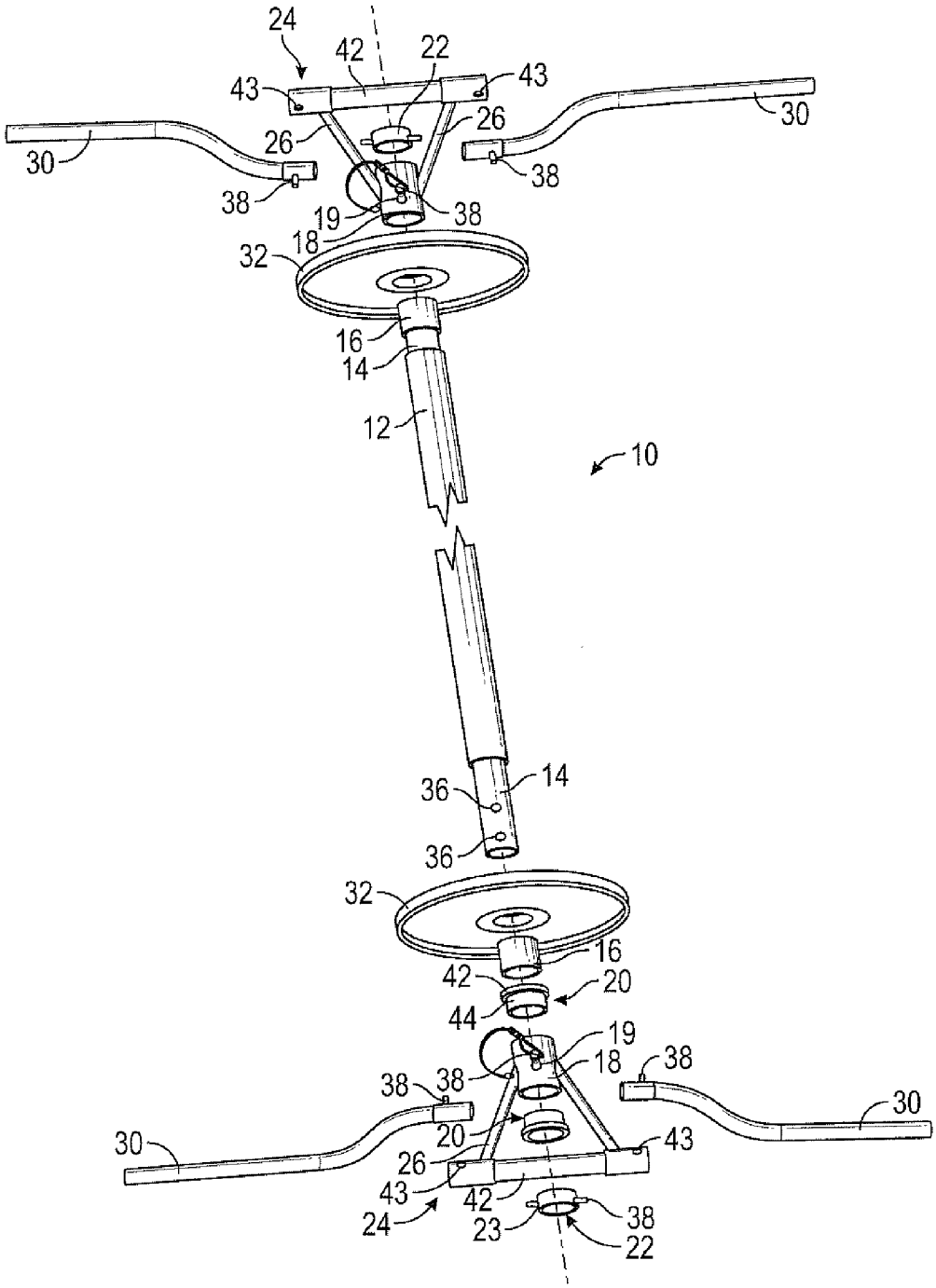
FIG. 3 is a perspective, exploded view of the multidirectional exercise apparatus of FIG. 1, shown with weight plates and hand grips at both ends of the center bar.

FIGS. 1-3 show an embodiment of the exercise apparatus 10. As shown, the exercise apparatus 10 may have a center bar 12. The center bar 12 may be made of steel, aluminum, plastic, or any other suitable material. According to one embodiment, the center bar 12 may be approximately 60 inches long and the center bar 12 may have an outer diameter of between approximately 2.0-2.5 inches. It should be clearly understood, however, that substantial benefit may be derived from the center bar 12 having any other suitable length and having any other suitable outer diameter. The center bar 12 may be completely solid throughout its length. Alternatively, the center bar 12 may have a hollow channel formed through a portion of each end of the center bar 12 or the hollow channel may extend throughout the entire length of the center bar 12.

At each end of the center bar 12, there may be a plate post 14. The plate post 14 may be integral to the end of the center bar 12. Alternatively, the plate post 14 may be coupled to the end of the center bar 12; e.g. an end of the plate post 14 may be inserted into a hollow channel of the end of the center bar 12 and secured thereto. As shown in FIG. 3, the plate post 14 may have a slightly smaller outer diameter (e.g. 1.97 inches) than the outer diameter (e.g. 2.5 inches) of the center bar 12. The plate post 14 may be adapted to receive one or more weight plates 32 (see FIG. 3) thereon. The plate post 14 may have a hollow channel formed through at least a portion of the length of the plate post 14. Alternatively, the plate post 14 may have a hollow channel formed throughout its entire length. The plate post 14 and may also have at least two pairs of apertures 36 formed in the wall of the plate post 14, each pair of apertures 36 having one aperture 36 positioned opposite from the other (see FIG. 3). One pair of apertures 36 may be positioned on a medial end of the plate post 14 while the other pair of apertures 36 may be positioned on a lateral end of the plate post 14. Each pair of apertures 36 may be used as a part of a locking mechanism 34 (discussed below).

The exercise apparatus 10 may also have one or more spacers 16 at each end of the center bar 12. The spacer 16 may also be made of steel, aluminum, plastic, or any other suitable material. The spacer 16 may be cylindrical in shape with a hollow channel formed therethrough so that the plate post 14 may be inserted through the spacer 16. In one embodiment, the spacer 16 may be positioned medially on the plate post 14 in relation to the weight plates 32; in another embodiment, the spacer 16 may be positioned laterally on the plate post 14 in relation to the weight plates 32; and in yet another embodiment, two spacers 16 may be positioned on the plate post 14, one on each side of the weight plates 32. Alternatively, the spacer 16 may be used only when there are no weight plates 32 on the plate post 14, thus taking up the space on the plate post 14 that would otherwise be occupied by the weight plates 32. This would help to prevent other components of the exercise apparatus 10 from sliding out of place along the plate post 14.

The exercise apparatus 10 may also have a handle 24 coupled to one or both ends of the center bar 12. Each handle 24 may also be made of steel, aluminum, plastic, or any other suitable material. Each handle 24 may have a cross bar 42 positioned perpendicularly in relation to the center bar 12. Each handle 24 may also have a pivot tube 18 as well as a pair of connecting arms 26 that are coupled to and extend from the cross bar 42 toward the pivot tube 18. The connecting arms 26 may each be coupled at one end to the cross bar 42 and coupled at an opposite end to the pivot tube 18. In the embodiment shown in the figures, the connecting arms 26 may extend diagonally from the ends of the cross bar 42 toward the pivot tube 18, creating a triangular-shaped handle 24. The exercise apparatus 10 may also have padding 28 (see FIG. 2) coupled to one or both cross bars 42 to help protect the user's body against the hard material of the cross bar 42. In one embodiment, the padding 28 may be removable. Alternatively, the padding 28 may be firmly affixed to the cross bar 42. The pivot tube 18 may be cylindrical in shape with a hollow channel formed therethrough so that the plate post 14 may be inserted through the pivot tube 18. The pivot tube 18 may have an inner diameter (e.g. 2.25 inches) slightly larger than the outer diameter (e.g. 1.97 inches) of the plate post 14 so that the pivot tube 18 may rotate through a full 360° about the plate post 14. Each pivot tube 18 may also have an outer diameter (e.g. 2.5 inches) that is equal to the outer diameter (e.g. 2.5 inches) of the center bar 12 so that the exercise apparatus 10 may have a uniform outside diameter (e.g. 2.5 inches) throughout its entire length from one pivot tube 18 to the other.

The pivot tube 18 may also be locked into place with a locking mechanism 34 so as to prevent it from rotating about the plate post 14. In one embodiment, the pivot tube 18 may have at least one pair of apertures 19 formed in the wall of the pivot tube 18 that are positioned opposite from one another. When the plate post 14 has been inserted through the hollow channel of the pivot tube 18, the apertures 19 of the pivot tube 18 may be aligned with a corresponding pair of apertures 36 of the plate post 14 that are positioned medially along the plate post 14. A single pin 38 may then be inserted through the apertures 19 and the hollow channel of the pivot tube 18 as well as through the pair of medial apertures 36 and the hollow channel of the plate post 14 so that the pivot tube 18 may be locked into a fixed position in relation to the plate post 14. Alternatively, one pin 38 may be used to secure one of the pair of apertures 19 of the pivot tube 18 to one of the pair of medial apertures 36 of the plate post 14, while another pin 38 may be used to secure the other one of the pair of apertures 19 of the pivot tube 18 to the other one of the pair of medial apertures 36 of the plate post 14. The pin 38 may be a hitch pin, spring loaded pin, locking pin, taper pin, or any other suitable pin 38 that will securely couple the apertures 19 of the pivot tube 18 to the apertures 36 of the plate post 14. It should also clearly understood that any other type of suitable locking mechanisms 34 may be used to prevent rotation of the pivot tube 18 about the plate post 14. The locking mechanism 34 should be capable of being engaged to prevent rotation of the pivot tube 18 about the plate post 14 and capable of being disengaged to allow rotation of the pivot tube 18 about the plate post 14.

The exercise apparatus 10 may also have a pair of pivot bushings 20 to reduce friction between the pivot tube 18 and the plate post 14 when the pivot tube 18 is rotating. As shown in FIG. 3, one pivot bushing 20 may be coupled to the medial end of the pivot tube 18 and the second pivot bushing 20 may be coupled to the lateral end of the pivot tube 18. The length of each pivot bushing 20 should be such that they do not interfere with or block any apertures 19 within the pivot tube 18; i.e. a pin 38 should still be able to be inserted through the apertures 36 of the plate posts 14 and the apertures 19 of the pivot tubes 18 without interference from the pivot bushings 20. For example, if the pivot tube 18 has a length of 3.0 inches and its apertures 19 are positioned halfway along the length of the pivot tube 18 (e.g. at 1.5 inches), then each pivot bushing 20 may have a length of 1.0 inch.

Each pivot bushing 20 may be made of pliable material and may have an annular flange 42 and an elongated body 44 wherein the elongated body 44 is inserted into the hollow channel of the pivot tube 18. The pivot bushing 20 may also have a hollow channel formed therethrough so that the plate post 14 may be inserted through the pivot bushing 20. The annular flange 42 of the pivot bushing 20 may have an outer diameter (e.g. 2.5 inches) that is equal to the outer diameter of the pivot tube 18 (e.g. 2.5 inches) so that the annular flange 42 fits flush and even with the pivot tube 18. The elongated body 44 of the pivot bushing 20 may have an outer diameter (e.g. 2.25 inches) that is the same as, or slightly smaller than, the inner diameter (e.g. 2.25 inches) of the pivot tube 18. The elongated body 44 of the pivot bushing 20 may also have an inner diameter (e.g. 2.0 inches) that is slightly larger than, the outer diameter (e.g. 1.97 inches) of the plate post 14. The plate post 14 may be inserted through the hollow channel of the pivot bushing 20 so that it is the pivot bushing 20 that directly contacts the plate post 14.

The exercise apparatus 10 may also have a pair of end caps 22 coupled to the ends of the plate posts 14. Each end cap 22 may have an inner diameter (e.g. 2.0 inches) that is slightly larger than, the outer diameter (e.g. 1.97 inches) of the plate post 14. The plate post 14 may be cylindrical in shape with a hollow channel formed therethrough so that the plate post 14 may be inserted through the end cap 22. In an alternative embodiment, the end cap 22 may have a hollow channel formed only partially therethrough with a side wall on one end of the end cap 22. The end cap 22 may also have one or more apertures 23 formed in the side walls of the end cap 22. When the plate post 14 has been inserted through the hollow channel of the end cap 22, the apertures 23 of the end cap 22 may be aligned with the corresponding lateral pair of apertures 36 of the plate post 14. One pin 38 may then be inserted through the apertures 23 and the hollow channel of the end cap 22 as well as through the lateral pair of apertures 36 and the hollow channel of the plate post 14 so that the end cap 22 is firmly affixed to the plate post 14, preventing any components (i.e. the weight plates 32, the spacer 16, and the pivot tube 18) from slipping off of the plate post 14. Alternatively, one pin 38 may be used to secure one of the apertures 23 of the end cap 22 to one of the pair of medial apertures 36 of the plate post 14, while another pin 38 may be used to secure another aperture 23 of the end cap 22 to the other one of the pair of medial apertures 36 of the plate post 14.

Each handle 24 may have a pair of removable hand grips 30 coupled at each end of the cross bar 42. As shown in FIG. 2, the cross bar 42 may have two opposite ends. The ends of the cross bar 42 may have an outer diameter (e.g. 1.5 inches) that is larger than the outer diameter (e.g. 1.25 inches) of the center portion of the cross bar 42. However, it should be clearly understood that substantial benefit may be derived from the cross bar 42 having a uniform outer diameter throughout its entire length. Each end of the cross bar 42 may be cylindrical in shape and have a hollow channel into which the hand grip 30 may be inserted. Alternatively, the cross bar 42 may have a hollow channel formed through its entire length. A locking mechanism 34 may be used to couple the hand grip 30 to the end of the cross bar 42. For example, as shown in FIG. 3, each end of the cross bar 42 may have at least one aperture 43 formed in the wall of the end of the cross bar 42. The proximal end of each hand grip 30 may have at least one spring loaded pin 38 that may engage the corresponding aperture(s) 43 in the end of the cross bar 42 when the proximal end of the hand grip 30 is inserted into the end of the cross bar 42. However, it should be clearly understood that substantial benefit may be derived from any suitable locking mechanism 34.

Figure 4:
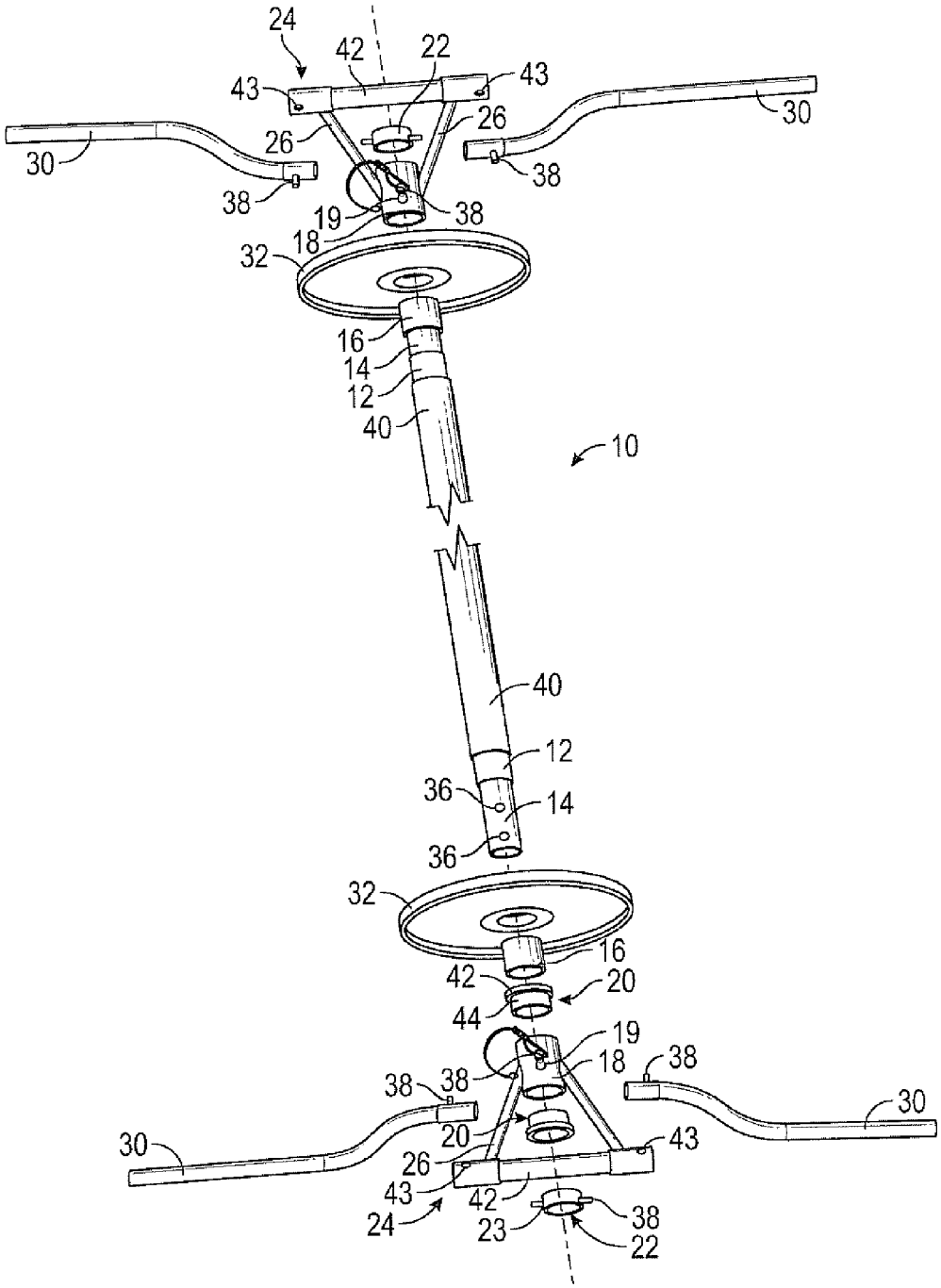
FIG. 4 is a perspective, exploded view of the multidirectional exercise apparatus in accordance with one or more aspects of the present invention, shown with a rotation bar coupled about the center bar.

Referring to FIG. 4, the exercise apparatus 10 may have a rotation bar 40 positioned about the center bar 12. The rotation bar 40 may be made of polyvinyl chloride (PVC), polycarbonate (PC), or any other suitable material. The rotation bar 40 may rotate a full 360° about the center bar 12. The rotation bar 40 may have a length (e.g. 60 inches) that is the same as the length (e.g. 60 inches) of the center bar 12. It should be clearly understood that substantial benefit may still be derived if the rotation bar 40 has a shorter length than the center bar 12. The rotation bar 40 may have an inner diameter (e.g. 2.0 inches) that is equal to, or slightly smaller than, the outer diameter (e.g. 2.0 inches) of the center bar 12. The rotation bar 40 may also have an outer diameter (e.g. 2.375 inches) that is equal to the outer diameters of the pivot tube 18, pivot bushings 20, and the spacers 16 so that the exercise apparatus 10 may have a uniform outside diameter (e.g. 2.375 inches) throughout its entire length from one pivot tube 18 to the other. The rotation bar 40 may be removed, by disconnecting a handle 24, any spacers 16, and any weight plates 32 from one end of the exercise apparatus 10 and sliding the rotation bar 40 off of the center bar 12.

According to another embodiment of the exercise apparatus 10, the handles 24 may be permanently fixed to or integral with the two opposite ends of the center bar 12. In this embodiment, the handles 24 may not rotate about the end of the center bar 12. Each handle 24 may also have a pair of hand grips 30 permanently fixed to or integral with the two opposite ends of the cross bar 42. In this embodiment, the center bar 12 and handles 24, and hand grips 30 (if present) may be formed as one continuous piece. This embodiment may also have a rotation bar 40 coupled about the center bar 12 that is adapted to rotate a full 360° about the center bar 12. In this embodiment, the exercise apparatus 10 may have one or more weight plates 32 permanently attached at one end or both ends of the exercise apparatus 10, wherein the weight plates 32 would be positioned between the end of the center bar 12 and a handle 24. Alternatively, the exercise apparatus 10 may have no weight plates 32 attached thereto.

Statement of Operation

Figure 5:
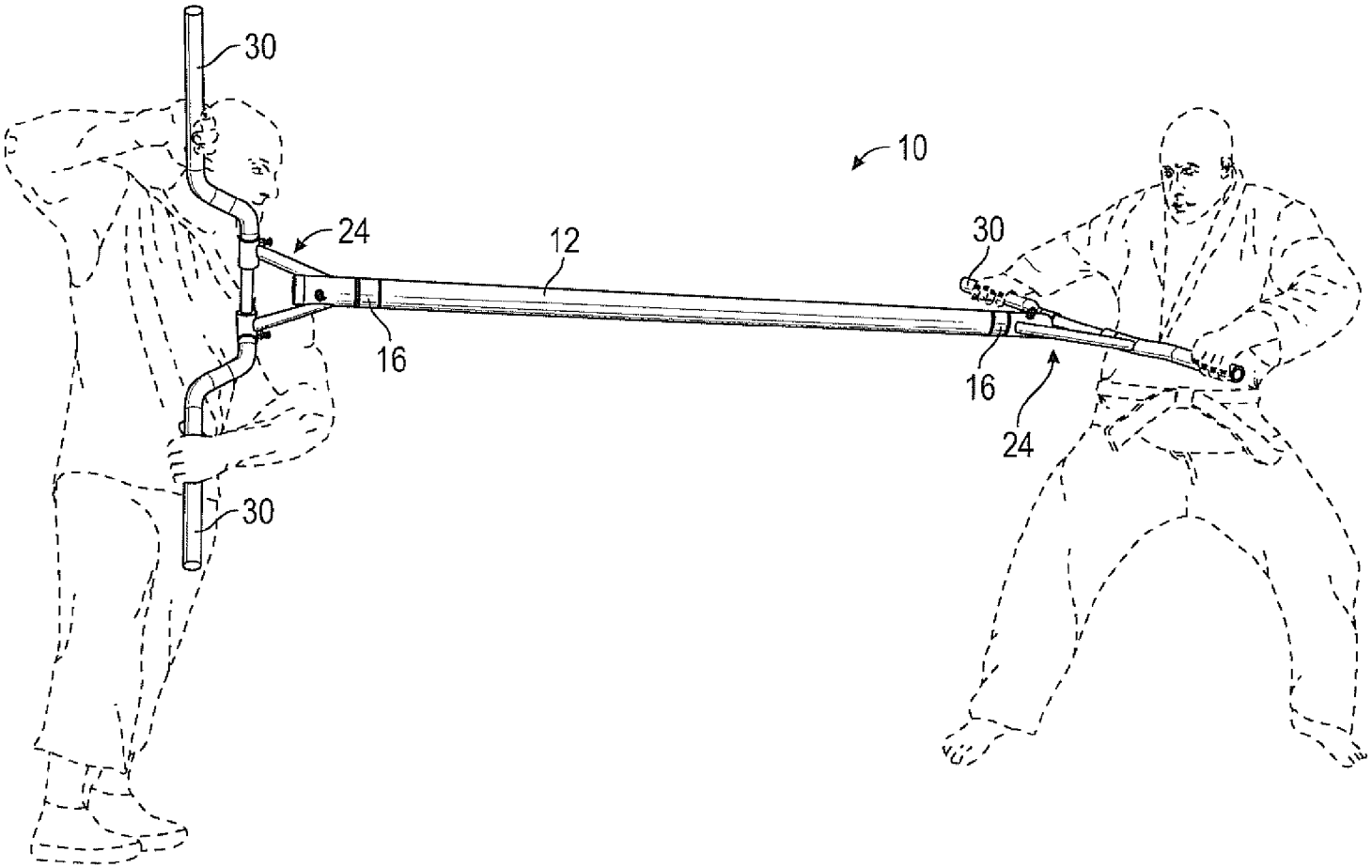
FIG. 5 is a perspective view of the multidirectional exercise apparatus of FIG. 1, shown in use by two users.

Referring to FIG. 5, the exercise apparatus 10, may be operated by two users simultaneously. When in use, each user may hold his respective handle 24. If the hand grips 30 are attached to the cross bar 42, the users may hold their respective hand grips 30 for a wide grip. If the hand grips 30 are not attached to the cross bar 42, the users may hold their respective cross bars 42 for a narrower grip and/or isolateral grip (i.e. using a single hand/arm to work one particular side of the body at a time). The users may exercise different muscle groups, depending upon whether they are using a wide grip, narrower grip, and/or single hand/arm. Furthermore, each user must not only use certain muscle groups to support or hold up his end of the exercise apparatus 10 and any weight plates 32 coupled thereto, but each user may also need to employ other muscle groups to oppose the pushing, pulling, and rotation forces that are applied by the other user. Different exercises may be performed by the users depending upon the setup of their respective handles 24. For example, both pivot tubes 18 may be permitted to rotate about their plate posts 14, both pivot tubes 18 may be locked into place with the locking mechanisms 34 to prevent rotation about their plate posts 14, or one pivot tube 18 may be permitted to rotate about its plate post 14, while the other pivot tube 18 may be locked into place.

Other exercises may be performed when the exercise apparatus 10 is operated by two users simultaneously. These exercises may include, but are not limited to: standing oppositional chest press for deltoids, chest, triceps, abdominals, forearm/grip strength, leg strength, and stability; standing opposition back row for deltoids, trapezius, latissimus dorsi, rhomboids, biceps, forearm/grip strength, leg strength, and stability; standing two man saw for abdominals deltoids, biceps, triceps, and leg/hip power strength; standing rainbow rotational core resist for abdominals, deltoids, biceps, triceps, leg/hip strength, and stability; standing oppositional isolateral/single leg balance drill for legs and abdominal strength, and stability; and ground base standing stability squat for leg strength and stability.

Figure 6:
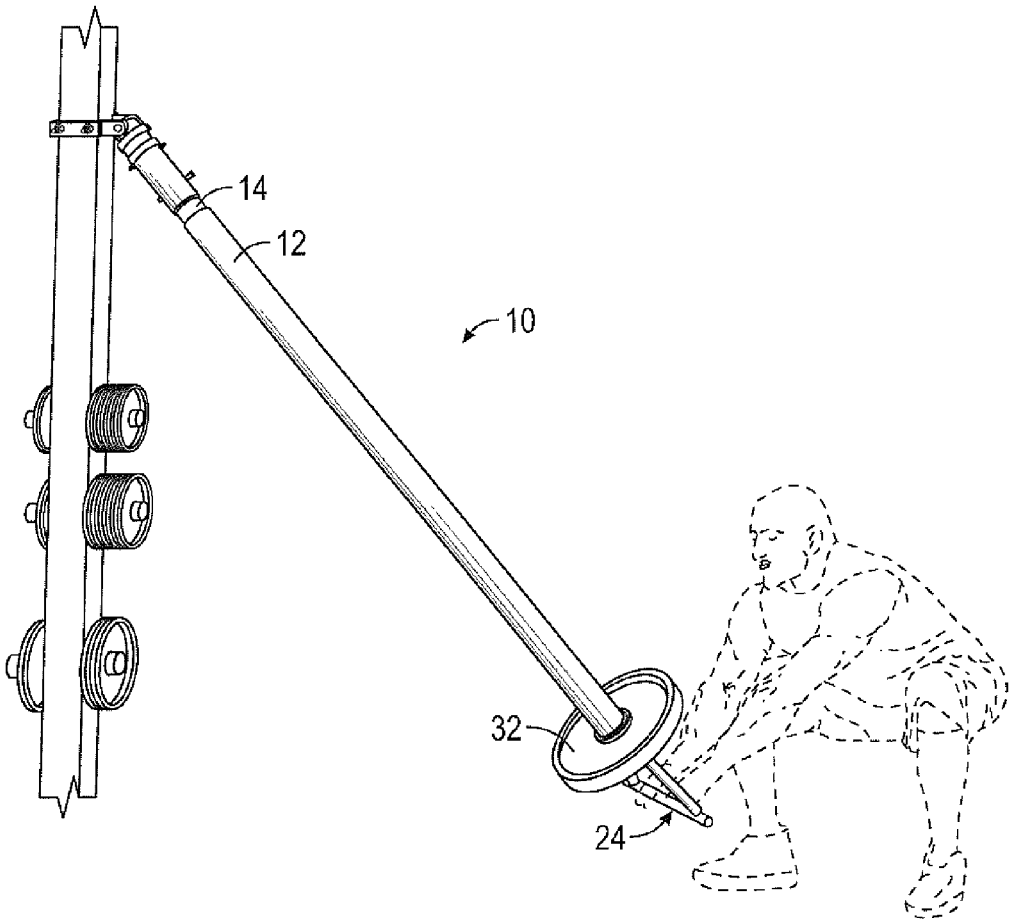
FIG. 6 is a perspective view of the multidirectional exercise apparatus of FIG. 1, shown in use by a single user and shown with one end of the center bar coupled to a weight rack.

Referring to FIG. 6, the exercise apparatus 10 may also be operated by a single user. For example, a user may grasp the center bar 12 with his hands and perform various barbell strength/power lifts. Alternatively, the end cap 22 and weight plate 32 may be removed from one end of the center bar 12. Removing the end cap 22 may expose the apertures 36 of the plate post 14 that the end cap 22 had formerly been coupled to. These apertures 36 may then be used to couple the plate post 14 to a wall mount, a weightlifting rack, weightlifting cage, or to a "landmine" floor mount. As another alternative, weight plates 32 may be loaded on to both plate posts 14 and set on the ground. Hand grips 30 may also be coupled to each cross bar 42. One use (or two users) may then stand on their respective hand grips 30 and attempt to balance and resist the tipping of the hand grips 30 or the rolling movements of the exercise apparatus 10 across the ground.

Other exercises may be performed when the exercise apparatus 10 is operated by a single user. These exercises may include, but are not limited to: fat bar strength power lifts for chest, back, forearm/grip, leg strength, and power wherein using the rotation bar 40 helps to allow for freedom of wrist movement through varying lifts; and landmine/uneven swing lifts for chest, back, biceps, triceps, abdominals, leg strength, power, and stability.

The foregoing description is illustrative of particular embodiments of the application, but is not meant to be a limitation upon the practice thereof. While embodiments of the disclosure have been described in terms of various specific embodiments, those skilled in the art will recognize that the embodiments of the disclosure may be practiced with modifications within the spirit and scope of the claims.

What is claimed is:

1. A multidirectional exercise apparatus comprising:
- a center bar having two opposite ends;
- two plate posts extending from the two opposite ends of the center bar;
- two triangular-shaped handles, each handle rotatably coupled to one plate post extending from one end of the center bar, wherein each handle comprises:
  - a pivot tube rotatably coupled about one of the plate posts;
  - a cross bar positioned perpendicularly in relation to the center bar; and
  - two connecting arms, wherein each connecting arm is coupled at one end to the pivot tube and coupled at another end to the cross bar and wherein each connecting arm is positioned diagonally between the pivot tube and the cross bar; and
- wherein each handle is positioned perpendicularly to the center bar.

2. The apparatus of claim 1 further comprising a locking mechanism coupled to each pivot tube, wherein the locking mechanism locks the pivot tube in place and prevents the pivot tube from rotating about the plate post.

3. The apparatus of claim 1 wherein each handle further comprises two handle grips, each handle grip removably coupled to one end of the cross bar.

4. The exercise apparatus of claim 1 further comprising at least one weight plate coupled about at least one of the plate posts.

5. The exercise apparatus of claim 1 further comprising a rotation bar removably coupled about the center bar, wherein the rotation bar is adapted to rotate about the center bar to allow for free wrist movement throughout a lift.

6. A multidirectional exercise apparatus comprising:
- a center bar having two opposite ends;
- a rotation bar removably coupled about the center bar, wherein the rotation bar is adapted to rotate about the center bar to allow for free wrist movement throughout a lift;
- two plate posts extending from the two opposite ends of the center bar;
- two triangular-shaped handles, each handle rotatably coupled to one plate post extending from one end of the center bar, wherein each handle comprises:
  - a pivot tube rotatably coupled about one of the plate posts;
  - a cross bar positioned perpendicularly in relation to the center bar; and
  - two connecting arms, wherein each connecting arm is coupled at one end to the pivot tube and coupled at another end to the cross bar and wherein each connecting arm is positioned diagonally between the pivot tube and the cross bar; and
- two end caps, each end cap coupled about one of the plate posts.

7. The apparatus of claim 6 further comprising at least two spacers, each spacer coupled about one of the plate posts and positioned between the center bar and the pivot tube.

8. The apparatus of claim 6 wherein an outer diameter of each plate post is smaller than an outer diameter of the center bar and wherein the pivot tubes each have an outer diameter equal to the outer diameter of the center bar.

9. The apparatus of claim 6 further comprising
- a medial pair of apertures formed on each plate post, the medial pair of apertures positioned at a medial end of the plate post; and
- a pair of apertures formed on each pivot tube;
- wherein the pair of apertures on the pivot tube are adapted to be aligned with the medial pair of apertures on the plate post and to receive a pin therethrough to lock the pivot tube in place and prevent the pivot tube from rotating about the plate post.

10. The apparatus of claim 6 further comprising:
- a lateral pair of apertures formed on each plate post, the lateral pair of apertures positioned at a lateral end of the plate post; and
- a pair of apertures formed on each end cap;
- wherein the pair of apertures on the end cap are adapted to be aligned with the lateral pair of apertures on the plate post and to receive a pin therethrough to lock the end cap in place and prevent the handles from slipping off of the plate post.

11. The apparatus of claim 6, wherein each handle further comprises two handle grips, each handle grip removably coupled to one end of the cross bar.

12. The apparatus of claim 11 further comprising:

at least one aperture formed on each end of each cross bar;

at least one pin coupled to a proximal end of each hand grip;

wherein the proximal end of each hand grip is adapted to be inserted into the end of one of the cross bars and the at least one pin on the hand grip is adapted to engage the at least one aperture formed on the end of the cross bar.

13. The exercise apparatus of claim 6 further comprising at least one weight plate coupled about at least one of the plate posts.

14. The exercise apparatus of claim 6 wherein each plate post has a smaller outside diameter than an outside diameter of the center bar and wherein the pivot tubes and end caps all have an outside diameter equal to the outside diameter of the center bar.

15. A method of exercise involving two users comprising the steps of:

providing a multidirectional exercise apparatus comprising:

a center bar having two plate posts extending from two opposite ends of the center bar;

two triangular-shaped handles, each handle rotatably coupled to one of the plate posts, wherein each handle comprises:

a pivot tube rotatably coupled about one of the plate posts;

a cross bar positioned perpendicularly in relation to the center bar; and two connecting arms, wherein each connecting arm is coupled at one end to the pivot tube and coupled at another end to the cross bar and wherein each connecting arm is positioned diagonally between the pivot tube and the cross bar; and two locking mechanisms, one locking mechanism coupled to each handle, wherein the locking mechanism is adapted to lock the handle in place and prevent the handle from rotating about the plate post;

wherein each handle is positioned perpendicularly to the center bar;

gripping one handle by a first user;

gripping another handle by a second user;

supporting a weight of one end of the apparatus by the first user while resisting an opposing force applied by the second user.

16. The method of claim 15 further comprising the step of supporting a weight of an opposite end of the apparatus by the second user while resisting an opposing force applied by the first user.

17. The method of claim 15 further comprising the step of locking at least one of the handles in place with one of the locking mechanisms in order to prevent rotation of the handle about one of the plate posts.

* * * * *